US012601156B2

(12) United States Patent
Saini et al.

(10) Patent No.: US 12,601,156 B2
(45) Date of Patent: Apr. 14, 2026

(54) WORK MACHINE WITH OPERATOR DISPLAY

(71) Applicant: Caterpillar Inc., Peoria, IL (US)

(72) Inventors: Abhijeet Saini, Farmington Hills, MI (US); Brad Robert Van De Veer, Washington, IL (US); Patrick William Sullivan, Fieldbrook, IL (US); Aaron Robert Shatters, Montgomery, IL (US); Eric Wade Cler, Oswego, IL (US); Michael Anthony Spielman, Osseo, MI (US); Keven K. Lockwood, Morton, IL (US); Wayne E. Harshberger, II, Oswego, IL (US)

(73) Assignee: Caterpillar Inc., Peoria, IL (US)

( * ) Notice: Subject to any disclaimer, the term of this patent is extended or adjusted under 35 U.S.C. 154(b) by 128 days.

(21) Appl. No.: 18/444,931

(22) Filed: Feb. 19, 2024

(65) Prior Publication Data

US 2025/0263910 A1 Aug. 21, 2025

(51) Int. Cl.
*E02F 9/26* (2006.01)
*E02F 3/43* (2006.01)

(52) U.S. Cl.
CPC ..... *E02F 9/264* (2013.01); *E02F 3/435* (2013.01)

(58) Field of Classification Search
CPC ..... E02F 9/264; E02F 3/435
See application file for complete search history.

(56) References Cited

U.S. PATENT DOCUMENTS

| | | | | |
|---|---|---|---|---|
| 3,643,828 | A * | 2/1972 | Elliott | F15B 21/08 414/701 |
| 5,000,650 | A * | 3/1991 | Brewer | E02F 3/434 172/812 |
| 7,797,860 | B2 | 9/2010 | Schoenmaker et al. | |
| 8,160,783 | B2 * | 4/2012 | Shull | E02F 3/435 701/50 |
| 8,500,387 | B2 * | 8/2013 | Trifunovic | E02F 3/432 701/50 |
| 9,650,755 | B2 | 5/2017 | Nomura et al. | |
| 10,106,951 | B2 * | 10/2018 | Myers | E02F 3/34 |
| 10,161,111 | B2 | 12/2018 | Daishi et al. | |
| 10,590,630 | B2 | 3/2020 | Hasegawa | |
| 11,078,647 | B2 | 8/2021 | Morimoto | |
| 2009/0222176 | A1 * | 9/2009 | Florean | F15B 15/2861 701/50 |
| 2009/0326768 | A1 * | 12/2009 | Shull | E02F 3/435 701/50 |
| 2012/0057956 | A1 * | 3/2012 | Shirao | E02F 3/433 414/707 |
| 2016/0273196 | A1 * | 9/2016 | Funk | E02F 3/432 |
| 2020/0165798 | A1 | 5/2020 | Nishi | |
| 2021/0062473 | A1 | 3/2021 | Ding et al. | |

* cited by examiner

*Primary Examiner* — Tyler J Lee

(57) ABSTRACT

A work machine featuring a boom and equipped with sensors to detects its rotation angle, along with a bucket attached to the boom and fitted with sensors to detect its tilt angle is disclosed. A controller manages the adjustment of both angles based on operator input. After adjustment, the controller processes sensor data to determine the bucket's carry height relative to a predetermined range. The system displays guidance information on an operator display within the machine's cab, displaying real-time feedback on the bucket's position relative to the predetermined range.

20 Claims, 6 Drawing Sheets

WORK MACHINE WITH OPERATOR DISPLAY

TECHNICAL FIELD

The present disclosure generally relates to a work machine, and more particularly, to a work machine having an operator display.

BACKGROUND

A work machine may be equipped for a boom and bucket attached to the boom. A work task, such as a load carrying operation, may require an operator of the work machine to raise the boom and rotate the bucket to dig a load, such as an earthen or construction material, into the bucket. In the load carrying operation, the bucket is further rotated upwards to carry the load and the work machine transports the load to a desired location for dumping. In the context of a wheeled loader, racking typically refers to positioning the bucket in a specific orientation to the ground supporting the loader. The bucket full of construction or earthen material is considered racked, or in the carry position, when it is tilted, or rotated, relative to the ground, upwards towards the boom of the wheeled loader. The racked, or carry position, is a position suitable for carrying a load such as soil, gravel, or debris in the bucket without spilling as it is transported to a dumping site.

During the carrying of the load, an operator will try and maintain a bucket carry height such that the bucket avoids contract with the ground surface and the bucket is not raised too high as to introduce bucket wobble. The bucket may wobble when the boom is raised high enough that the bucket will rotate off of mechanical stops located on the boom in order to keep the bucket level. However, many operators are unaware of any optimal bucket carry height or have not been trained to recognize what the optimal bucket carry height is.

U.S. Pat. No. 10,590,630 discloses a work vehicle that allows an operator to check the vertical position and the angle of a bucket. The work vehicle includes a front loader with a bucket, and freely raises/lowers and rotates the bucket. The work vehicle has a display located near an operator seat. The display is used to display vertical position information and information of the bucket.

While effective, there remains a need for improved operator displays and control systems for work machines used in high wear applications, such as construction and mining.

SUMMARY

In accordance with one aspect of the present disclosure, a work machine is disclosed. The work machine has a boom and bucket, both integrated with sensors detecting their respective rotational and tilting angles. A controller manages adjustments to these angles upon receiving operator commands. Following these adjustments, the controller processes sensor data to determine the bucket's carrying height. This calculated height is then compared to a predetermined bucket carry height range. The guidance information regarding the bucket's position relative to the predetermined bucket carry height range is displayed on an operator display within the machine's cab, allowing for immediate feedback on if the bucket carry height is above, below, or within the predetermined bucket carry height range.

In accordance with another aspect of the present disclosure, a display system for a work is disclosed. The display system integrates a boom pivotally linked to the work machine at one end and a bucket at the opposite end, both equipped with sensors detecting rotation and tilt angles. Having an operator display within the cab and a memory unit storing predetermined carry height thresholds, the display system is controlled by a controller adjusting the boom to modify the bucket's carry height. This controller obtains the rotation and the tilt angle data, determines the bucket's position, calculates its carry height, and displays relevant guidance information on an operator display indicating if the bucket is below, above, or within the predetermined bucket carry height range.

In accordance with another aspect of the present disclosure, a computer-implemented display is disclosed. The system has a controller that processes rotation angle data from a boom sensor and tilt angle data from a bucket sensor. Stored within a memory unit are predetermined carry height parameters, including upper and lower thresholds. The controller receives and analyzes sensor data, determining the bucket's position based on rotation and tilt angles. Upon identifying the bucket in a carry position, it computes the bucket's carry height, compares it to the predefined range, and generates output guidance information. This guidance information is then promptly displayed on an operator interface, providing real-time feedback for efficient monitoring and adjustment of the work machine's bucket position to maintain optimal carry height."

These and other aspects and features of the present disclosure will be more readily understood when read in conjunction with the accompanying drawings.

DETAILED DESCRIPTION

Figure 1:
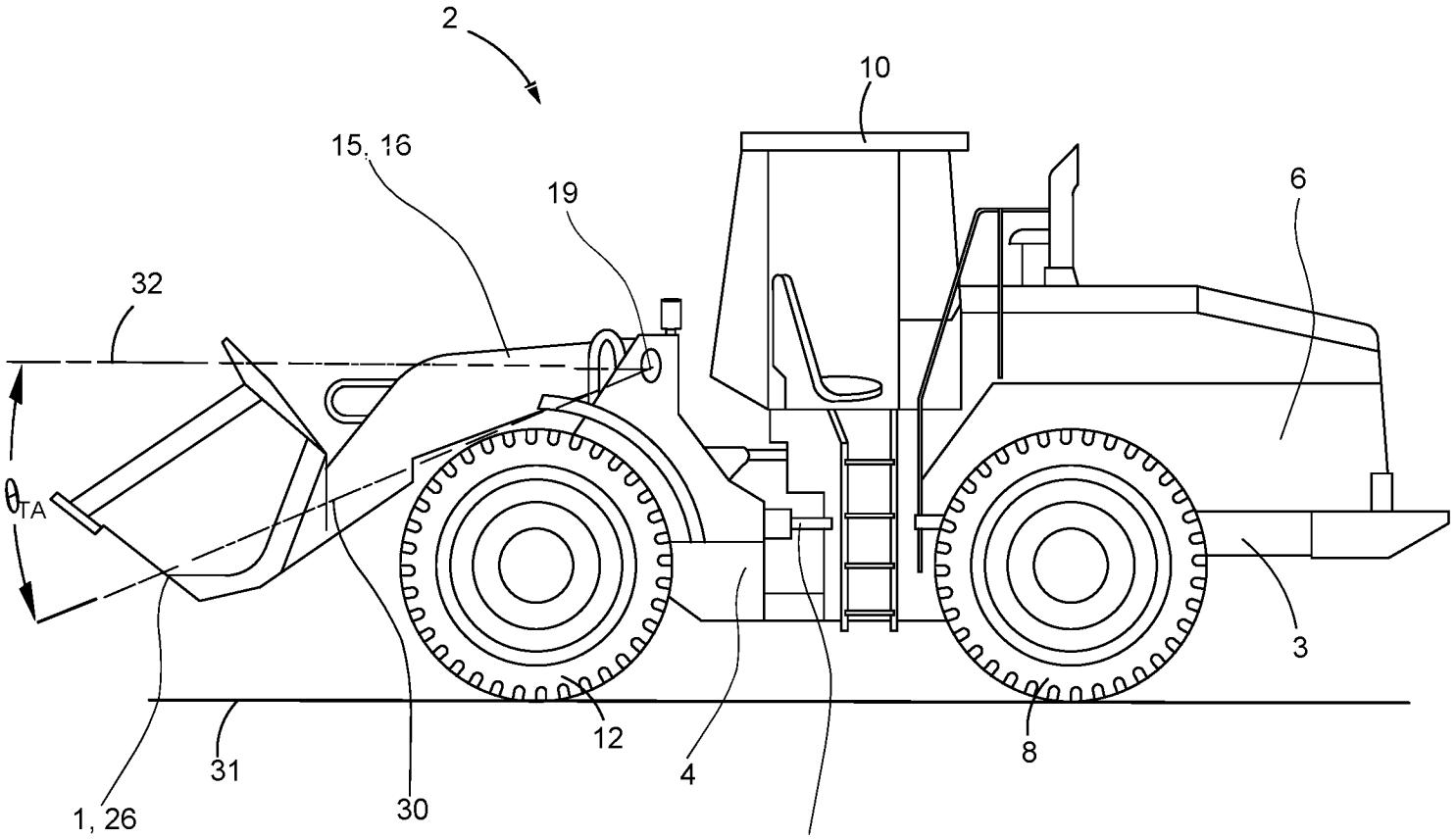
FIG. 1 is a side view of a work machine, in accordance with the present disclosure.
Figure 2:
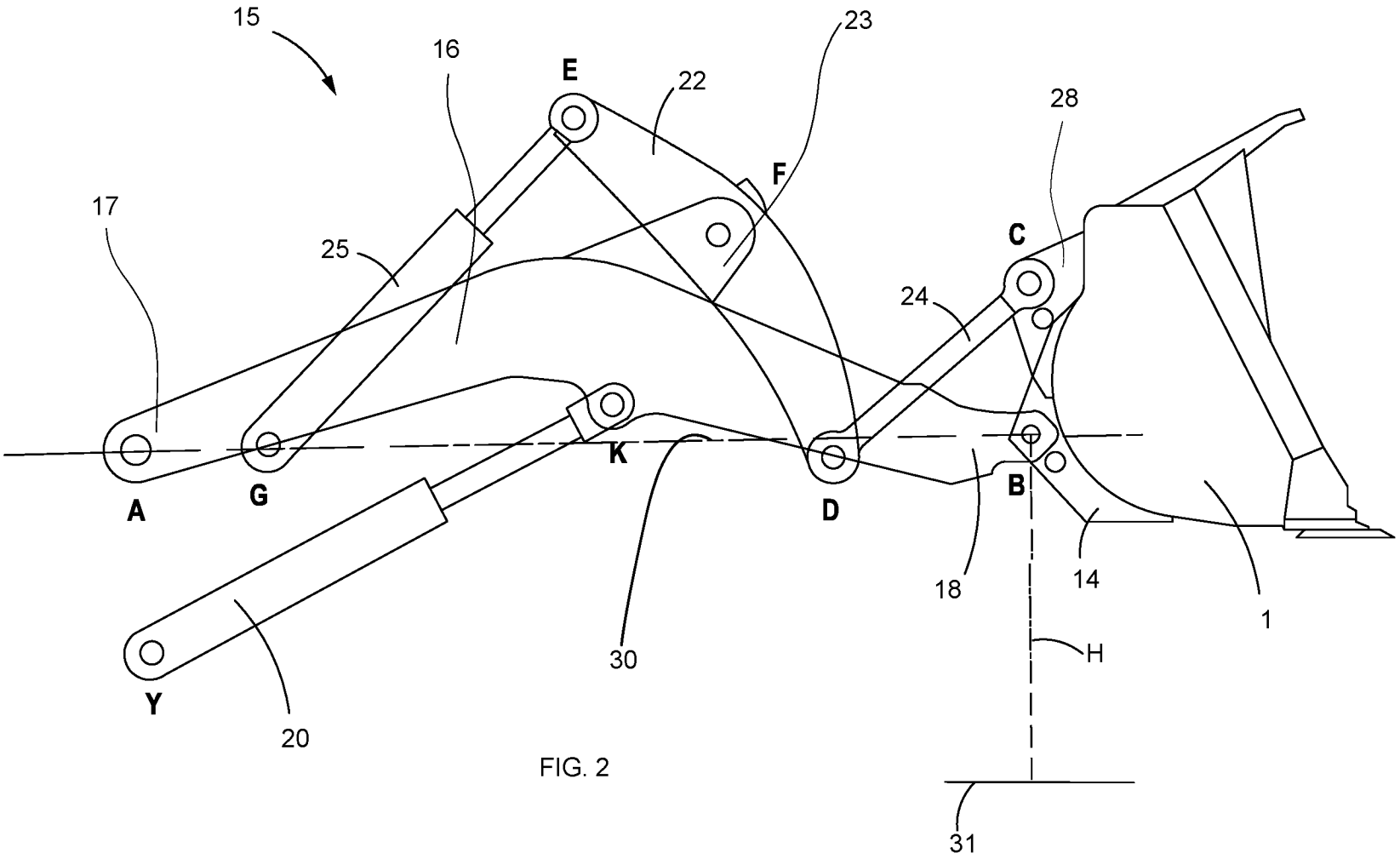
FIG. 2 is a side view of a bucket attached to a boom included in the work machine of FIG. 1, in accordance with the present disclosure.

Referring to FIG. 1, an implement 1 is attached to a work machine 2. The work machine 2 may embody a fixed or mobile machine that performs some type of operation associated with an industry such as mining, construction, farming, transportation, or any other industry involving heavy machinery. For example, the work machine 2 may be an earth moving machine such as a wheel loader, an excavator, a dozer, a motor grader, an electric rope shovel, or any other earth moving machine. The work machine 2 includes a body portion 3 and a non-engine end frame 4 connected by an articulating joint 5. The body portion 3 houses an engine 6 that drives the rear wheel 8 and includes an elevated operator's cab 10 for the operator. The end frame 4 has front wheels 12 that are turned by a steering mechanism (not shown), with the articulating joint 5 allowing the end frame 4 to move from side-to-side to turn the work machine 2. In the illustrated embodiment, an implement 1 in the form of a bucket is mounted at the front of the end frame 4 of a coupler 14 (as shown in FIG. 2). The bucket 1 and the coupler 14 may be configured for secure attachment of the bucket 1 during use of the work machine, and for release of the bucket 1 and substitution of another implement (not shown). Although the coupler 14 and the bucket 1 are illustrated and described as being separate connectable components, those skilled in the art will understand that each implement, including buckets, may be configured as a unitary component having a material engaging portion, such as the bucket, forks, clams, and the like, and a coupling portion having the points of attachment for connecting the implement to the work machine 2.

As best shown in FIG. 2, the coupler 14 is connected to the end frame 4 by a boom 15. In one exemplary embodiment, the boom 15 includes a pair of lift arms 16. A first end 17 of each lift arm 16 is rotatably connected to the end frame 4 and a second end 18 of each lift arm 16 is rotatably connected to the coupler 14 proximate the bottom of the coupler 14. The lift arms 16 rotate about a point of connection 19 (FIG. 1) to the end frame 4, with the rotation of the lift arm 16 being controlled by corresponding lift cylinders 20 pivotally coupled to the end frame 4 at a head end of the lift cylinders 20 and at the lift arms 16 at a rod end of the lift cylinders 20. The lift cylinders 20 may be extending by adding pressurized fluid to the head and draining fluid from the rod end to raise the lift arms 16 and retracted by adding fluid to the rod end and draining pressurized fluid from the head end to lower the lift arms 16. In typical implementations, two lift arms 16 are provided, with each having corresponding lift cylinder 20. However, a single lift arm 16 and a lift cylinder 20, two lift arms 16 driven by a single lift cylinder 20, or other arrangements of lift arms 16 and lift cylinders 20 providing similar functionality as kinematic elements may be implemented.

The rotation of the coupler 14 and attached implement may be controlled by a Z-bar linkage of the end frame 4. The Z-bar linkage may include a tilt lever 22 pivotally connected to a tilt lever support 23 mounted on the lift arms 16 such that the tilt lever support 23 moves with the lift arms 16. At one end of the tilt lever 22, a tilt link 24 has one end pivotally connected to the end of the tilt lever 22, and the opposite end pivotally connected to the coupler 14 proximate the top of the coupler 14. A tilt cylinder 25 couples the opposite end of the tilt lever 22 to the end frame 4 with pivotal connections at either end. For a given position of the lift arms 16, the coupler 14 and implement are rotated towards a racked position by extending the tilt cylinders 25 and rotated in the opposite direction towards a dump position by retracting the tilt cylinder 25.

Each of the connections between the elements that move with respect to one another is made by a pivot pin about which the elements rotate. Consequently, the lift arms 16 may be connected to the end frame 4 by pivot pins A and to the coupler 14 by pivot pins B. The tilt link 24 may be connected to the coupler 14 by a pivot pin C and to the tilt lever 22 by a pivot pin D. The tilt lever 22 may be connected to the tilt cylinders 25 by a pivot pin E and to the tilt lever support 23 by a pivot pin F. The opposite end of the tilt cylinder 25 may be connected to the end frame 4 by a pivot pin G. Finally, a lift cylinder rod end of the lift cylinders 20 may be connected to the lift arms 16 by pivot pins K and a lift cylinder head end of the lift cylinder 20 may be connected to the end frame 4 by pivot pins Y. Because the pivot pins A, G, Y are attached to the end frame 4, the distance between the pivot pins A, G, Y is fixed.

Figure 3:
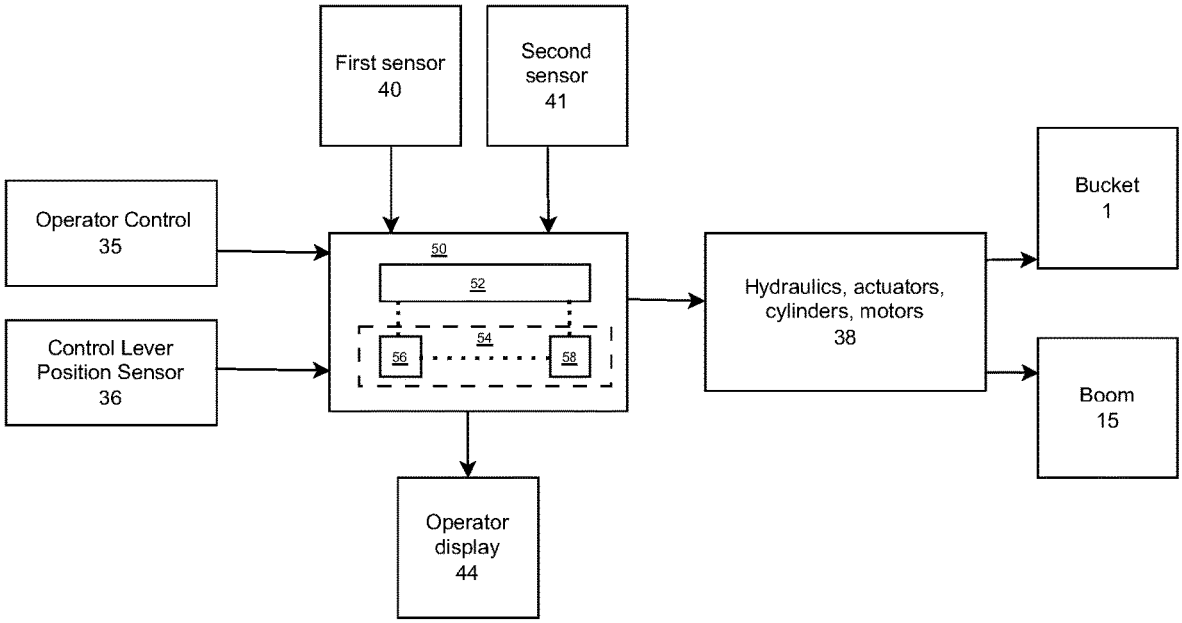
FIG. 3 is a block diagram illustrating a control system included in the work machine, in accordance with the present disclosure.

Referring now to FIG. 3, the work machine 2 may include various control components utilized in adjusting a bucket carry height (H) and determining the bucket carry height (H). The work machine 2 may include a controller 50 capable of receiving information in signals from control devices, sensors, and other input devices, processing the received information using software stored therein, and outputting information to output devices such as actuators and displays that cause the work machine 2 to operate and provide information to the operator of the work machine 2. The controller may include a microprocessor 52 for executing a specified program, which controls and monitors various functions associated with the work machine 2. The microprocessor 52 includes a memory 54, such as read only memory (ROM) 56, for storing a program, and random access memory (RAM) 58 which serves as a working memory area for use in executing the program stored in the memory. Although the microprocessor is shown, it is also possible and contemplated to use other electronic components such as a microcontroller, an ASIC (application specific integrated circuit) chip, or any other integrated circuit device.

The controller electrically connects to the control elements of the work machine 2, as well as various input devices for commanding the operation of the work machine 2 and monitoring performance of the work machine 2. As a result, the controller may be electrically connected to input devices detecting operator input and providing control signals to the controller that may include an operator control position sensor. The operator control position sensor may be operatively connected to an operator control with the operator's cab 10 and may sense a displacement of the operator control indicative of an operator's intent to raise or lower the boom 15. The operator control position sensor may respond by outputting an operator control position signal that corresponds to the displacement of the operator control. The greater the displacement of the operator control from a neutral position, the faster the operator desires to raise or lower the boom 15 in the commanded direction. A value transmitted in the operator control position sensor signal will correspond to the direction and magnitude of the displacement of the operator control, and the controller may be configured to interpret the operator control position sensor signal.

The controller may be connected to sensing devices providing control signals with values indicating real-time operating conditions of the work machine 2, such as a first sensor 40, also referred to as the boom angle sensor 40, for detecting a rotation angle of the boom and a second sensor 41, also referred to as the bucket angle sensor 41, for detecting a tilt angle of the bucket. The first or second sensors may be a rotary encoder, shaft encoder or other appropriate device for converting an angular position of an element into an analog or digital signal. The first sensor may be operatively connected to the lift arm, or the end frame, to detect, or measure, the rotation angle $\theta_{RA}$ of the boom 15 (or lift arms 16) relative to the end frame 4 and may output a first sensor signal to the controller that corresponds to the rotation angle $\theta_{RA}$ of the boom 15. The rotation angle $\theta_{RA}$, as shown in FIG. 1, is the angle between a longitudinal axis 30 of the lift arm 16, also referred to as the center axis of the boom 30, that passes through pivot pin A and pivot pin B (FIG. 2) and a horizontal axis 42 that extends from the pivot pin A away from the work machine and is parallel to the ground surface 31.

The second sensor may be operatively connected to the bucket 1, or the boom 15, to detect, or measure, a tilt angle $\theta_{TA}$ of the bucket 1 relative to the boom 15 (or tilt arms 16) and may output a second sensor signal to the controller that corresponds to the tilt angle $\theta_{TA}$ of the bucket 1.

In another exemplary embodiment, the first and second sensors are not angular position sensors and instead are hydraulic pressure sensors. Some examples include either a head end pressure sensor (not shown) or a rod end pressure sensor (not shown) located on the lift cylinder 20 or the tilt cylinder 25, respectively, for measuring the rotation angle $\theta_{RA}$ of the boom 15 with the first cylinder and the tilt angle $\theta_{TA}$ of the bucket 1 with the second sensor. In an even further exemplary embodiment, the first and second sensors may each be an accelerometer (not shown) for measuring the rotation angle $\theta_{RA}$ of the boom 15 with the first cylinder and the tilt angle $\theta_{TA}$ of the bucket 1 with the second sensor.

The controller may also be electrically connected to output devices to which control signals are transmitted and from which control signals may be received by the controller, such as, for example, a lift cylinder actuator, a tilt cylinder actuator, or an operator display located in the operator's cab 10. The lift cylinder actuator may be operative coupled to the lift cylinder 20 to cause pressurized fluid flow to the lift cylinder 20 causing the lift cylinder 20 to extend and retract to correspondingly rotate the lift arms 16 to raise and lower the bucket 1 to change the bucket carry height. The lift cylinder actuator may be a solenoid or other type of actuator to which the controller may output a boom height adjustment signal or solenoid current to move a corresponding valve element (not shown) to positions to create fluid flow to the lift cylinder 20 corresponding to the operator control position sensor signals received by the controller from the operator control position sensor. The values of the lift cylinder control signals may be based on a commanded fluid flow determined by the controller from the operator control position sensor signals to cause the lift cylinder actuator to rotate the lift arms 16 in the direction and at the speed commanded by the operator at the operator control.

The operator display may be any appropriate display or analog display device capable of receiving signals from the controller and displaying a sensory perceptible output of the display signals. The display signals to the display device may include the detected rotation angle of the boom received from the first sensor, or the tilt angle of the bucket received from the second sensor. In some implementations, the operator display may include a touch-sensitive screen capable of displaying the information in the display signals from the controller while also allowing the operator to input commands at the operator display and generating corresponding machine control signals that may be transmitted from the operator display to the controller.

FIG. 1 illustrates an exemplary load carrying operation of the work machine 2 where the bucket carry height (H) may be derived from rotation angle of the boom 15 and/or the tilt angle of the bucket 1. The bucket carry height (H) is defined as the height of the bucket 1 off of the ground surface 31, and more specifically as shown in FIG. 2, is the bucket carry height (H) is the height of the B pin above the ground surface. Since the height of the A pin off of the ground surface 31 and the length between the A pin and the B pin for any given exemplary work machine 2 is known, and may be stored on the memory 54 and retrievable by the controller 50, the bucket carry height (H) is calculable for any given rotation angle $\theta_{RA}$ of the boom 15 by the controller 50. Further, different lengths and types of booms 15 may be stored on the memory 54 for calculating the bucket carry height (H).

The load carrying operation may begin with the boom 15 rotated downwardly so that the bucket 1 is disposed proximate the ground surface 31 with the bucket 1 titled such that a bottom surface 26 of the bucket 1 is parallel, or touching, the ground surface 31. The work machine 2 may be driven forward into a pile of work material (not shown) to accumulate a load (not shown) of the material in the bucket 1. The operator may operate the operator control 35 to cause the lift cylinder 20 to extend and rotate the lift arms 16 of the boom 15 to lift the bucket 1 out of the pile of work material. Further, while the boom 15 is rotated, the bucket 1 is tiled upwards towards the boom 15 to place the bucket 1 into a fully racked position. Once the bucket 1 is fully racked, the boom 15 and bucket 1 are considered in a carry position.

Figure 4:
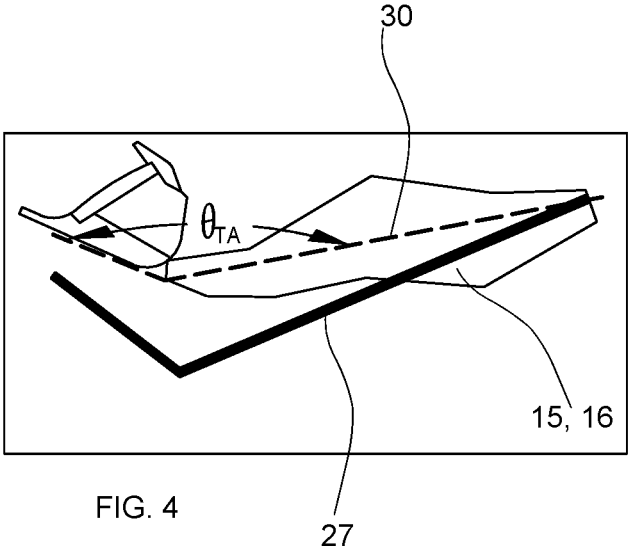
FIG. 4 is a side view of the boom and bucket of FIG. 2, in accordance with the present disclosure.
Figure 5:
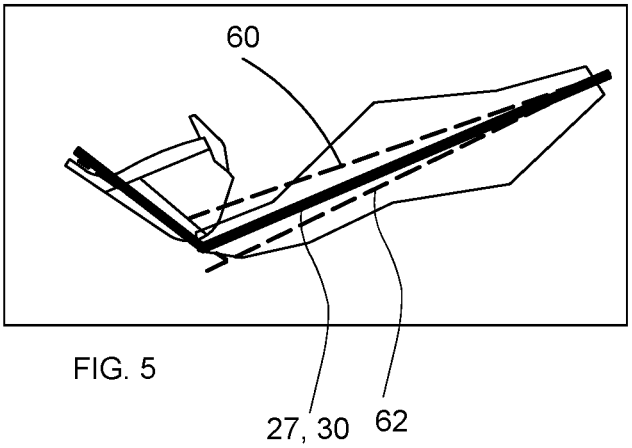
FIG. 5 is a side view of the boom and bucket of FIG. 2, in accordance with the present disclosure.
Figure 6:
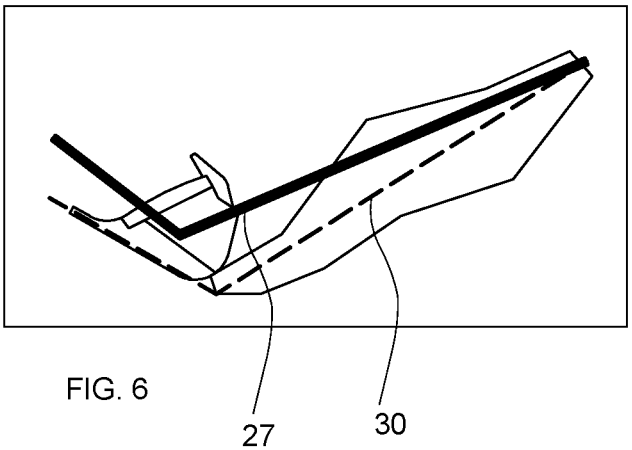
FIG. 6 is a side view of the boom and bucket of FIG. 2, in accordance with the present disclosure.
Figure 7:
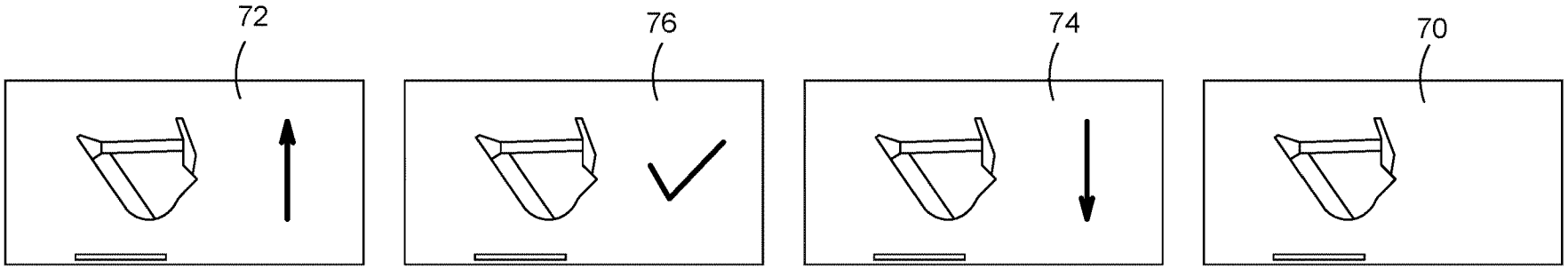
FIG. 7 is a block diagram of a display system routine in accordance with the present disclosure that may be executed by the work machine 2 of FIG. 1.

With reference to FIGS. 4-6, in the carry position, there is an optimal bucket carry height 27 where the bucket 1 where the bucket 1 is placed at rack stops 28 (FIG. 2). The rack stops 28 are mechanical stops that are located on the bucket 1, as shown, in FIG. 2, but may be placed on the boom 15 in other exemplary embodiments, that stop rotation of the bucket 1 and prevent the bucket 1 from rotating into the boom 15 when the bucket 1 is rotated towards the boom 15. In the carry position it is optimal to place the bucket 1 at the rack stops 28, or rather such that the bucket 1 is in contact with the boom 15 by way of the rack stops 28, to minimize vibrations of the bucket 1 to keep the load from vibrating out of the bucket 1 during the transportation of the load.

As shown in FIG. 4, when the boom 15, or rather the longitudinal axis 30 of the lift arm 16, is above the optimal bucket carry height 27, the tilt angle $\theta_{TA}$ of the bucket 1 is increased, in some exemplary embodiments this is done automatically by the work machine 2 and in other embodiments this is done by the operator using the operator control 35, in order to keep the load level with the ground surface 35 to prevent any spillage of the load as the boom 15 is raised. Since the tilt angle $\theta_{TA}$ is increased, the bucket 1 is tilted off of the rack stop 28, or the rack stop 28 is tilted off of the boom 15 depending on if the rack stop 28 is located on the boom 15 or the bucket 1. When the bucket 1 is tilted off of the rack stop 28 it is considered off-rack and the bucket 1 does not receive the added benefits of being in contact with the boom 15 to dampen any vibrations during the transportation of the load. Further, having the bucket 1 off-rack exposes the bucket to any additional forces caused by the movement of the work machine 2, such as centripetal forces as the work machine 2 is turned, that would be dampened if the bucket 1 was racked.

Turning to FIG. 5, the longitudinal axis 30 of the lift arms 16 is shown to be perfectly aligned with the optimal bucket carry height 27. In this exemplary embodiment, as the boom 15 is raised, the bucket 1 is tilted towards the boom 15, and the tilt angle $\theta_{TA}$ of the bucket 1 is decreased. The tilt angle $\theta_{TA}$ of the bucket 1 is decreased as the bucket carry height (H) is increased by raising the boom 15 until the longitudinal axis 30, or center axis, of the boom 15 is aligned with the optimal bucket carry height 27. Thus, in the optimal bucket carry height 27 the bucket 1 is racked with the bucket 1 being placed against the boom 15 via the rack stop 28. The optimal bucket carry height 27 will vary depending on the type and size of the implement 1 as well as the type and size of the work machine 2 but can be determined as the bucket carry height (H) when the bucket 1 is in the carry position and is racked.

FIG. 6 illustrates the bucket carry height (H) when the boom 15 is below the optimal bucket carry height 27. In this exemplary embodiment, the bucket 1 has not been tilted towards the boom 15 enough to rack the bucket 1. When the longitudinal axis 30 of the lift arms 16 of the boom 15 is below the optimal bucket carry height 27, the bucket 1 cannot retain the full load due to large of tilt angle $\theta_{TA}$ of the bucket 1, and the bucket 1 is thus tilted forward and the load may fall out of the front of the bucket 1 during transportation of the load. Further, the bucket 1 runs the risk of striking the ground surface 31 if it is too close to the ground.

Figure 9:
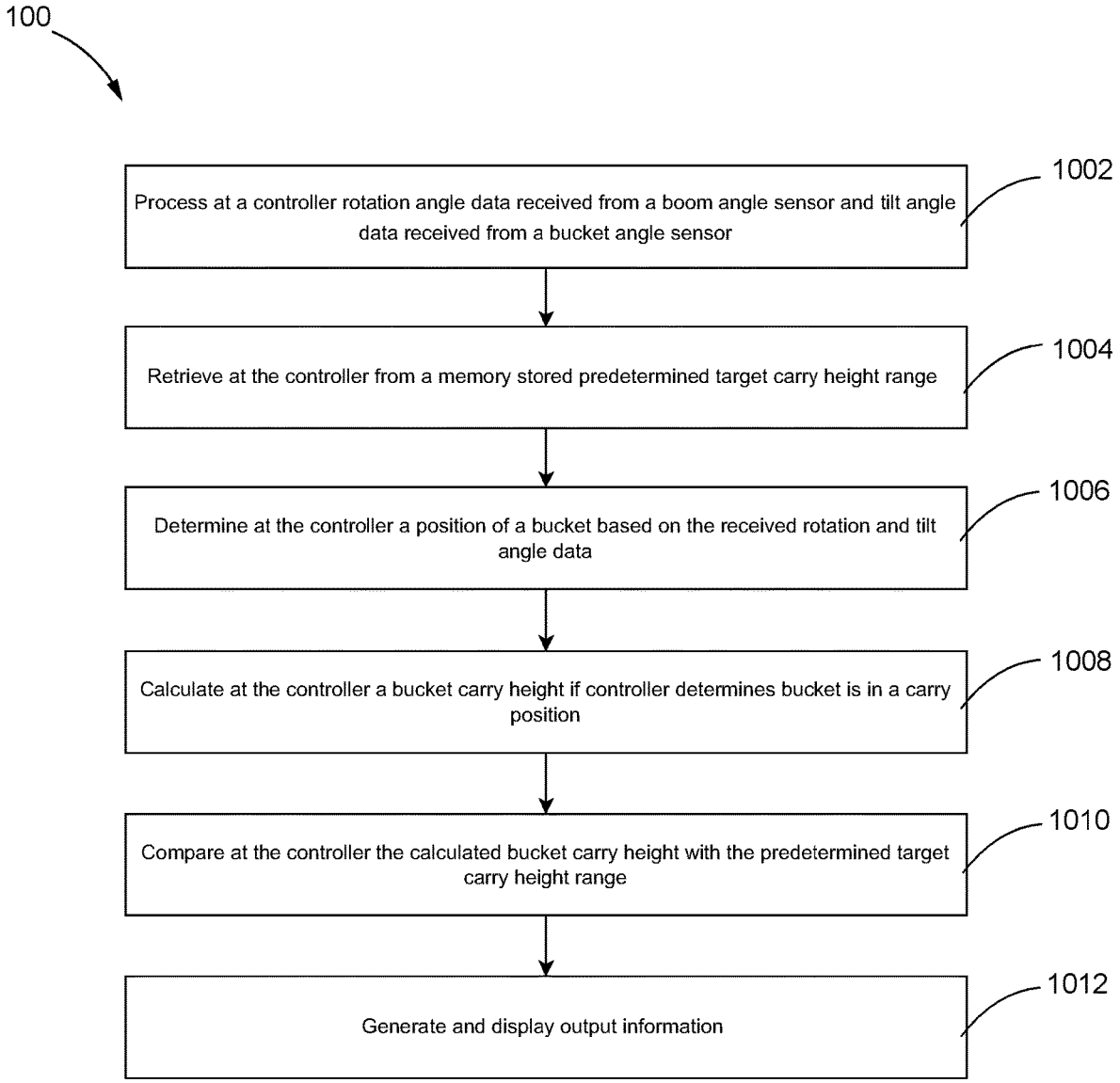
FIG. 9 is a diagram illustrating an example of the operator display for the work machine of FIG. 1, in accordance with the present disclosure.

The operator display 44, as shown in FIG. 9 is a display device that includes a touch panel-type input unit 45 and a display unit 46 such as a liquid crystal display (LCD). The operator display 44 is located in the operator cab 10 to allow for machine condition information to be displayed and easily viewable by the operator of the work machine 2. Such machine condition information includes, for example, battery voltage, hydraulic oil temperature, as well as displaying the tilt angle $\theta_{TA}$ of the bucket received at the controller 50 and the controller displaying on the operator display 44. Additionally, as described below, the operator display 44 displays a dynamic real-time bucket carry height information widget, referred to as the bucket carry height information 48. The operator display 44 and the controller 50 are communicable to each other via a wired or wireless communication means.

The operator display 44, the controller 50, and any of the above mentioned elements of the work machine 2 may constitute a display system for providing the operator with information for determining if the boom 15 needs to be raised or lowered when the bucket 1 is in the carry position.

FIG. 4 illustrates an exemplary bucket carry height information routine 100 of the above-mentioned display system. At block 1002, the controller 50 receives, and processes any raw or unconverted data, the rotation angle $\theta_{RA}$ of the boom 15 measured from the first sensor 40. Additionally, the controller 50 receives the tilt angle $\theta_{TA}$ of the bucket 1 measured from the second sensor 41.

At block 1004, the controller 50 retrieves from the memory 54 stored a predetermined target carry height range 52. The target carry height range 52 is a predetermined range that the bucket carry height (H) may be in to minimize bucket 1 wobble when carrying a load. The target carry height range 52 includes the optimal bucket carry height 27 within the range but includes an upper threshold 60 above the optimal bucket carry height 27 and a lower threshold 62 below the optimal bucket carry height 27 as shown in FIG. 5. In one exemplary embodiment, the predetermined upper threshold 57 is set to provide a maximum bucket carry height (H) for stability and load retention. Further, in another exemplary embodiment, the predetermined lower threshold 62 is set at a minimum bucket carry height (H) as per any Operation and Maintenance Manual (OMM) of the work machine. In one exemplary embodiment, the lower threshold 62 is set at the B pin being between 200 and 600 millimeters above the ground surface 31. In another exemplary embodiment, the lower threshold 62 is set the B pin at 400 millimeters above the ground surface 31. In an even further exemplary embodiment, the upper threshold 60, or the B pin height at off rack, is set between 601 millimeters and 1700 millimeters.

At block 1006, the controller 50 determines a position of the bucket 1 based on the received rotation angle $\theta_{RA}$ of the boom 15 and the received tilt angle $\theta_{TA}$ of the bucket 1. The positions of the bucket 1 may include the carry position, the digging position, and the dumping positions to name a few. The controller 50, in one exemplary embodiment, determines that the bucket 1 is in the carry position if the controller 50 adjusts, based on a bucket adjustment signal 64 received from the operator control 35, the tilt angle $\theta_{TA}$ of the bucket 1 to rotate the bucket upwards towards the boom 15 and away from the ground surface 31. This adjustment may happen during or after the raising or lowering of the boom 15. If the controller determines that the bucket 1 is in the carry position, the bucket 1 controller 50 will continuously consider the bucket 1 to be in the carry position until the controller determines a received measured rotation angle $\theta_{RA}$ of the boom 15 is such that the longitudinal axis 30 of the lift arms 16 of the boom has risen above the horizonal axis 32.

Figure 8:
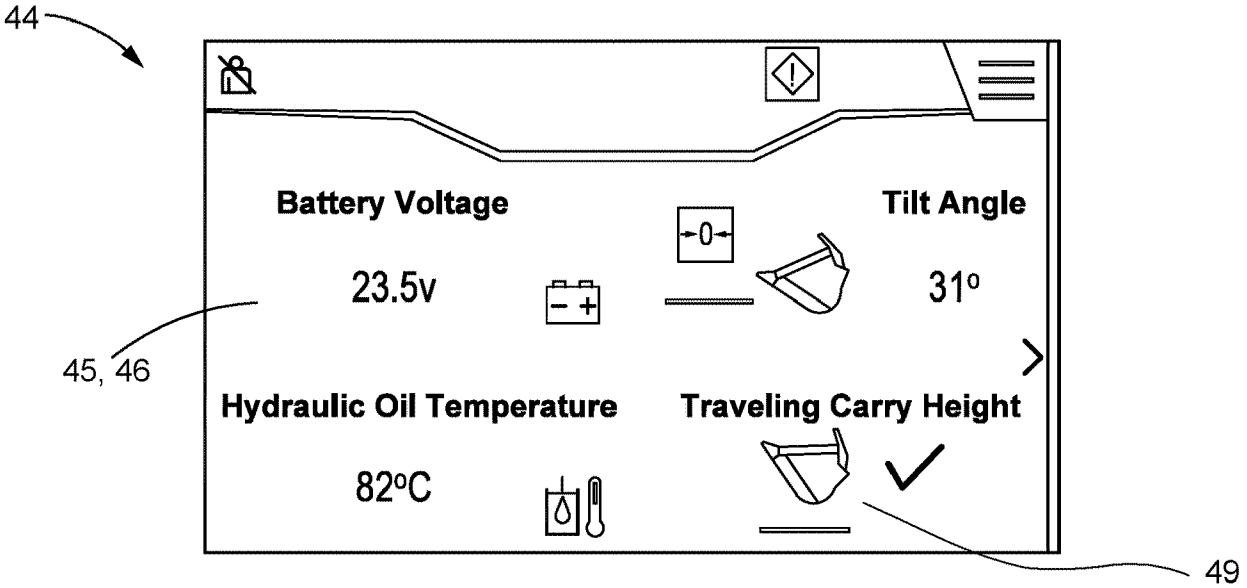
FIG. 8 is a diagram illustrating exemplary screens or icons displayed on an operator display for the work machine 2 of FIG. 1, in accordance with the present disclosure.

At block 1008, the controller 50 calculates the bucket carry height (H) if the controller 50 determined that the bucket 1 is in the carry position. If the controller 50 determines that the bucket is either not racked back or not trying to carry, or if the rotation angle $\theta_{RA}$ is greater than zero (the longitudinal axis 30 of the boom 15 is raised above the horizonal axis 32) then the controller 50 will display a not carrying icon 70 (FIG. 8) of the bucket 1 as the bucket carry height guidance information 49 displayed on the operator display 44. As shown, icon 70 does not have any further information indicating corrections for operator of the bucket carry height. The bucket carry height (H) is calculated from the received rotation angle $\theta_{TA}$ of the boom 15, the received tilt angle $\theta_{TA}$ of the bucket 1, and, in some exemplary embodiments, the B pin height at the axle center line. In one exemplary embodiment, the B pin height at the axle center line of the work machine 2 is stored on the memory 54 for retrieval by the controller 50 for calculating the bucket carry height (H) and may be in a range of 700 to 1000 millimeters.

At block 1010 the controller 50 compares the calculated bucket carry height (H) with the retrieved target carry height range 52. At block 1012, if the controller 50 determines that the calculated bucket carry height (H) is below the lower threshold 62 of the target carry height range 52, the controller 50 will display on the operator display 44 a raise bucket icon 72 (FIG. 8) as the bucket carry height guidance information 49. The raise bucket icon 72 depicts a side silhouette of the bucket 1 along with an up arrow. Although an up arrow is depicted, in another exemplary embodiment, any indicia, symbol, or icon may be used to convey to the operator that the bucket carry height (H) is too low and that the boom 15 needs to be raised.

If the controller 50 determines that the calculated bucket carry height (H) is above the upper threshold 60 of the target carry height range 52, the controller 50 will display on the operator display 44 a lower bucket icon 74 (FIG. 8) as the bucket carry height guidance information 49 at block 1012. The lower bucket icon 74 depicts a side silhouette of the bucket 1 along with a down arrow. Although a down arrow is depicted, in another exemplary embodiment, any indicia, symbol, or icon may be used to convey to the operator that the bucket carry height (H) is too high and that the boom 15 needs to be lowered.

Further, at block 1012, if the controller 50 determines that the calculated bucket carry height (H) is between the lower threshold 62 and the upper threshold 60 of the target carry height range 52, the controller 50 will display on the operator display 44 a within range icon 76 (FIG. 8) as the bucket carry height guidance information 49. The within range icon 76 depicts a side silhouette of the bucket 1 along with a check mark. Although check mark is depicted, in another exemplary embodiment, any indicia, symbol, or icon may be used to convey to the operator that the bucket carry height (H) is within the target carry height range 52, and the bucket carry height (H) does not need to be adjusted further by raising or lowering the boom 15.

INDUSTRIAL APPLICABILITY

The work machine 2 and display system of the present disclosure, as depicted in FIGS. 1-9 above, relate to increasing operational efficiency, enhancing safety measures, and facilitating precise control during work machine 2 maneuvers involving a boom 15 and a bucket 1 in the construction and heavy machinery industries.

A work machine 2 is discloses that includes a boom 15 rotatably coupled to the work machine 2 at a first end 17 and a bucket 1 rotatably coupled to a second end 18 of the boom 15. The operation of the work machine 15 is facilitated by a set of sensors, including a first sensor 40 responsible for detecting the rotation angle of the boom 15 and a second sensor 41 designed to detect the tilt angle of the bucket 1. A controller 50 integrated into the work machine 2 is configured to adjust both the rotation angle of the boom 1 and the tilt angle of the bucket 1 based on inputs received by an operator, thereby ensuring precise control during operational maneuvers.

Upon receiving signals indicating the need for adjustments, the controller 50 processes the detected rotation angle of the boom 15 and the detected tilt angle of the bucket 1. After effecting adjustments, the controller 50 determines a bucket carry height (H) based on the revised rotation and tilt angles. This determination is used in assessing the position of the bucket 1 concerning predetermined parameters, particularly a predetermined target carry height range 52 stored within a memory 54 of the work machine 2, or remotely accessible by the work machine 2.

A key feature of the present disclosure lies in the ability to provide comprehensive guidance information to the operator via an operator display 44 situated in the operator cab 10 of the work machine 2 to inform the operator whether the bucket is being carried at an optimal height. The display system conveys real-time data regarding the bucket carry height (H) concerning the predetermined target carry height range 52. Depending on the determination made by the controller 50, the operator display 44 presents graphical indications or bucket carry height guidance information to guide the operator in adjusting the bucket carry height (H). This guidance information includes graphical depictions, alerts, or indications prompting the operator to raise, lower, or maintain the bucket carry height (H) within the predetermined range.

The predetermined target carry height range 52 is defined by upper 60 and lower 62 thresholds stored in the memory 54. The lower threshold 62 sets the minimum acceptable bucket carry height off the ground 31, while the upper threshold 60 marks the point at which the boom 15 should not be raised further or the bucket 1 will not be racked. Additionally, specific buffer zones, or hysteresis regions, such as a 50 to 100 millimeter buffer below the lower threshold, or 50 to 100 millimeters above the upper threshold, are incorporated, guiding the controller 50 to display appropriate graphical indications for precise operational adjustments. The hysteresis regions prevent the controller 50 from flickering and displaying between different icons 70, 72, 72, 76 when the bucket carry height H is right at the upper or lower thresholds.

By incorporating this innovative display system into the work machine, operators benefit from heightened safety measures and increased operational efficiency. The system's ability to provide real-time graphical indications and actionable information empowers operators to make timely adjustments, ensuring that the bucket's carry height remains within the designated range, thereby enhancing safety protocols and optimizing operational productivity.

While the preceding text sets forth a detailed description of numerous different embodiments, it should be understood that the legal scope of protection is defined by the words of the claims set forth at the end of this patent. The detailed description is to be construed as exemplary only and does not describe every embodiment since describing every embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A work machine, comprising:

a boom rotatably coupled to a frame of the work machine at a first end of the boom;

a bucket rotatably coupled to the boom at a second end of the boom;

one or more sensors for detecting a rotation angle of the boom, wherein the rotation angle of the boom is to be adjusted based on a boom height adjustment signal from an operator control in a cab of the work machine; and a controller configured to:

obtain, from a first sensor of the one or more sensors, the rotation angle of the boom;

determine, based on the rotation angle of the boom, a bucket carry height of the bucket;

determine, based on the bucket carry height relative to a target bucket carry height range, bucket carry height guidance information; and display the bucket carry height guidance information on an operator display in the cab, wherein, when the bucket carry height is above the target bucket carry height range, the bucket carry height guidance information includes a graphical indication for an operator of the work machine to lower the bucket carry height.

2. The work machine of claim 1, wherein the controller is further configured to determine, prior to determining the bucket carry height, whether the bucket is in a carry position.

3. The work machine of claim 2, further comprising a second sensor, of the one or more sensors, for detecting a tilt angle of the bucket, wherein that the bucket is in the carry position includes determining, based on the tilt angle of the bucket, that the bucket is rotated upwards, away from a ground surface, and towards the boom prior to the rotation angle of the boom being adjusted.

4. The work machine of claim 3, wherein determining that the bucket is in the carry position further includes determining, based on the rotation angle of the boom, that a center axis of the boom is below a horizontal plane defined through an attachment point of the boom to the work machine.

5. The work machine of claim 2, wherein, based on determining that the bucket is not in the carry position, the bucket carry height guidance information includes a graphical depiction of only the bucket.

6. The work machine of claim 1, wherein the graphical indication includes an arrow that points down.

7. The work machine of claim 1, wherein when the bucket carry height is below the target bucket carry height range, the bucket carry height guidance information includes a graphical indication for an operator of the work machine to raise the bucket carry height.

8. The work machine of claim 7, wherein the graphical indication includes an arrow that points up.

9. The work machine of claim 1, wherein the target bucket carry height range includes an upper threshold and a lower threshold.

10. The work machine of claim 1, wherein the bucket carry height corresponds to a distance from a ground surface supporting the work machine to a central axis of a bucket pin that attaches the bucket to the boom.

11. The work machine of claim 9, wherein the lower threshold is a minimum bucket carry height above a ground surface supporting the work machine, and wherein, when the bucket carry height is less than the lower threshold, the bucket carry height guidance information includes a graphical indication for an operator of the work machine to raise the bucket carry height.

12. A work machine, comprising:

a boom rotatably coupled to a frame of the work machine at a first end of the boom;

a bucket rotatably coupled to the boom at a second end of the boom;

one or more sensors for detecting a rotation angle of the boom, wherein the rotation angle of the boom is to be adjusted based on a boom height adjustment signal from an operator control in a cab of the work machine; and a controller configured to:

obtain, from a first sensor of the one or more sensors, the rotation angle of the boom;

determine, based on the rotation angle of the boom, a bucket carry height of the bucket;

determine, based on the bucket carry height relative to a target bucket carry height range, bucket carry height guidance information; and display the bucket carry height guidance information on an operator display in the cab, wherein the bucket carry height corresponds to a distance from a ground surface supporting the work machine to a central axis of a bucket pin that attaches the bucket to the boom, wherein the lower threshold is a minimum bucket carry height above a ground surface supporting the work machine, and wherein, when the bucket carry height is less than the lower threshold, the bucket carry height guidance information includes a graphical indication for an operator of the work machine to raise the bucket carry height, wherein the lower threshold includes a hysteresis region, below the lower threshold, of 50millimeters to 100 millimeters, wherein the controller is further configured to maintain the same graphical indication when the bucket carry height temporarily enters the hysteresis region.

13. The work machine of claim 9, wherein the bucket is configured to rotate to contact mechanical stops on the boom when the bucket rotates to a carry position, and the upper threshold is when the bucket is rotated off of the mechanical stops as the carry height is increased past the upper threshold.

14. The work machine of claim 13, wherein the controller is configured to display a lower carry height graphical indication on the operator display when the bucket carry height is more than the upper threshold.

15. The work machine of claim 1, wherein when the bucket carry height is within the target bucket carry height range, the bucket carry height guidance information includes a graphical indication for an operator of the work machine that the bucket carry height is within the target bucket carry height range.

16. A work machine, comprising:

a boom pivotally linked to a frame of the work machine at one end;

a bucket pivotally linked to an opposite end of the boom;

a first sensor configured to identify a rotation angle of the boom;

a second sensor configured to identify a tilt angle of the bucket;

an operator display located in an operator cab of the work machine;

a memory unit configured to store a predetermined target carry height range having an upper threshold and a lower threshold; and a controller configured to raise or lower the boom to adjust a bucket carry height, obtain the rotation angle of the boom from the first sensor, obtain the tilt angle of the bucket from the second sensor, determine the bucket is in a carry position from the obtained rotation angle of the boom and the tilt angle of the bucket, calculate the bucket carry height when the bucket is in the carry position, and display guidance information on the operator display that the bucket is below, above, or within the predetermined target carry height range.

17. A display system for a work machine, comprising:

an operator display; and one or more processors, computer memory, and computer executable instructions stored on a non-transitory recording medium, wherein execution of the computer executable instructions by the one or more processors causes performance of a method comprising:

processing at a controller rotation angle data received from a boom angle sensor and processing tilt angle data received from a bucket angle sensor;

retrieving at the controller from a memory stored predetermined target carry height range;

determining at the controller a position of a bucket of the work machine based on the received rotation angle data and tilt angle data;

calculating at the controller a bucket carry height if determined the bucket is in a carry position;

comparing at the controller the calculated bucket carry height with the predetermined target carry height range; and generating at the controller output guidance information and displaying the guidance information on the operator display, and in response to determining that the bucket carry height is below or above the predetermined target carry height range, maintaining the bucket carry height until receiving a carry height adjustment signal generated by an operator control based on input provided by an operator of the work machine to the operator control.

18. The work machine of claim 16, wherein, when the bucket is above the predetermined target carry height range, the guidance information includes a graphical indication for an operator of the work machine to lower the bucket.

19. The display system of claim 17, wherein the guidance information includes graphical indication for the operator of the work machine to raise or lower the bucket carry height if the controller determines the bucket carry height is below or above, respectively, the predetermined target carry height range.

20. The display system of claim 19, wherein the controller is configured to raise or lower a boom of the work machine based on the received carry height adjustment signal received from the operator control.

* * * * *